US006050567A

United States Patent [19]

Zucco

[11] Patent Number: 6,050,567

[45] Date of Patent: Apr. 18, 2000

[54] BOARD GAME

[76] Inventor: Catherine A. Zucco, 7 Shadywood Dr., Rochester, N.Y. 14606-4920

[21] Appl. No.: 09/058,691

[22] Filed: Apr. 10, 1998

[51] Int. Cl.[7] ..... A63F 3/00

[52] U.S. Cl. ..... 273/246; 273/249

[58] Field of Search ..... 273/242, 243, 273/248, 249, 246, 251, 254, 244.2

[56] References Cited

U.S. PATENT DOCUMENTS

| | | | |
|---|---|---|---|
| 1,391,333 | 9/1921 | McManus | 273/249 |
| 1,652,851 | 12/1927 | Bendtin | 273/251 |
| 1,656,943 | 1/1928 | Firestone | 273/254 |
| 1,695,144 | 12/1928 | Edwards | 273/249 |
| 4,019,742 | 4/1977 | Thompson | 273/246 |
| 4,090,717 | 5/1978 | Rossetti | 273/249 |
| 4,116,450 | 9/1978 | Darrell | 273/249 |
| 4,333,655 | 6/1982 | Rudell et al. | 273/249 |
| 4,714,255 | 12/1987 | Henry | 273/249 |
| 4,953,871 | 9/1990 | Antwi | 273/252 |
| 5,092,606 | 3/1992 | Miller | 273/249 |
| 5,108,111 | 4/1992 | Bilodeau | 273/249 |
| 5,114,151 | 5/1992 | Bergerstock | 273/246 |
| 5,139,268 | 8/1992 | Garnett | 273/249 |
| 5,322,293 | 6/1994 | Goyette | 273/246 |
| 5,511,792 | 4/1996 | Simmons | 273/251 |
| 5,590,883 | 1/1997 | Brewer | 273/249 |

*Primary Examiner*—Jeanette Chapman
*Assistant Examiner*—Stephen L. Blau
*Attorney, Agent, or Firm*—Robert J. Bird

[57] ABSTRACT

A method of playing a sledrace game board which includes a starting point, a finish line, numerous interconnecting trails, pick card spaces, marker pieces and die to determine a random number which a player must move a marker. Cards are used to give a player further instructions.

1 Claim, 4 Drawing Sheets

Figures 1, 1A:
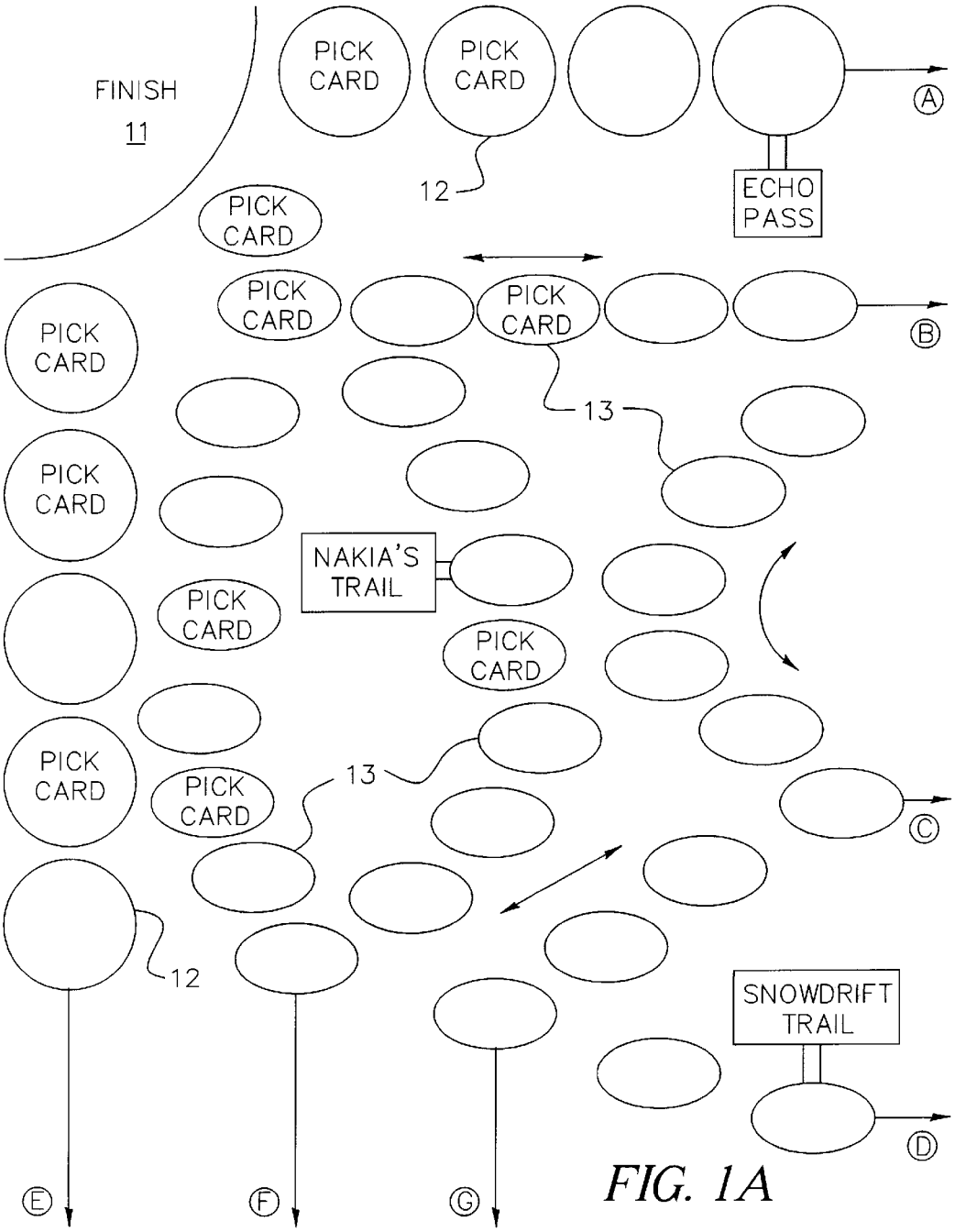
Figure 1B:
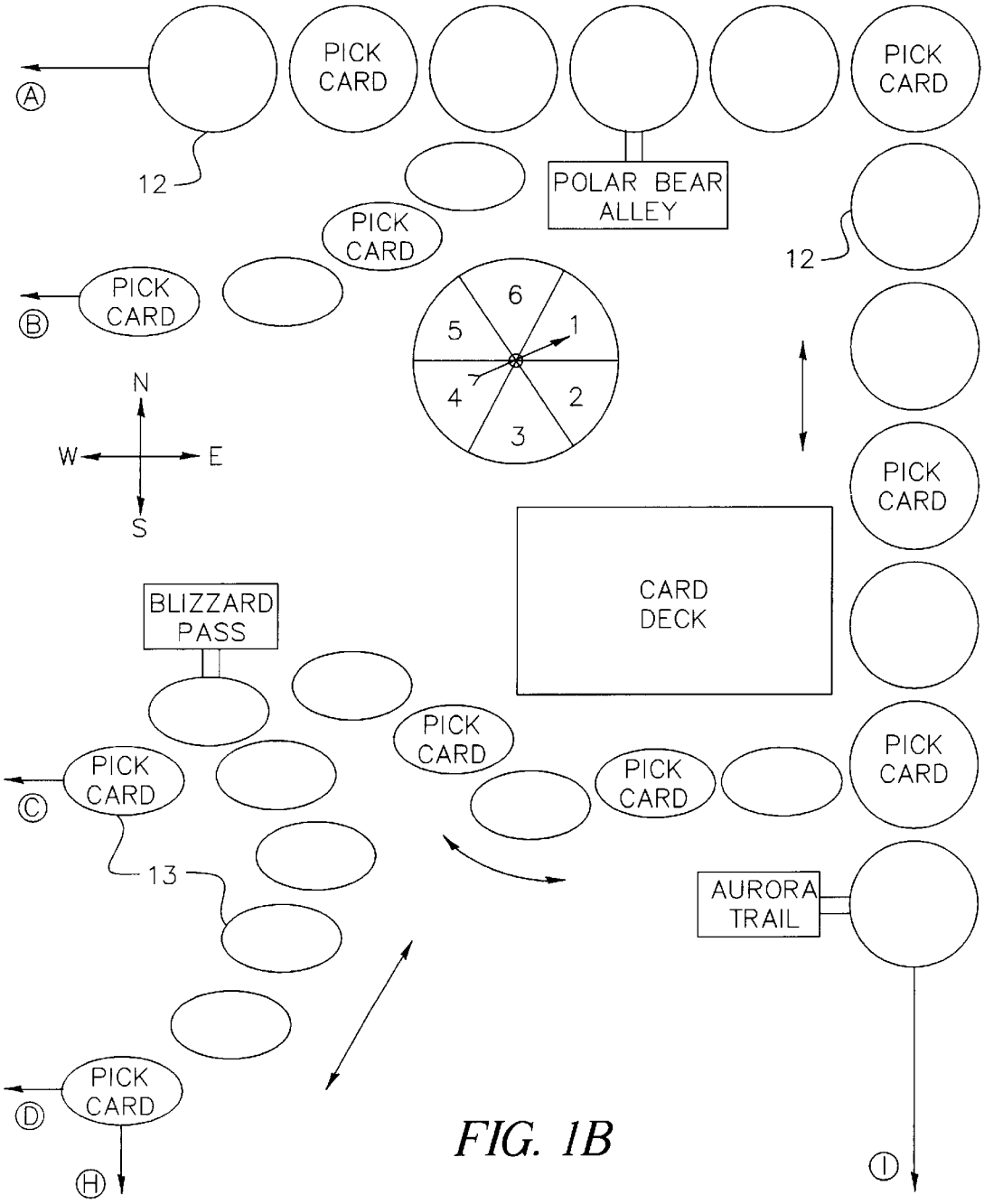
Figure 1C:
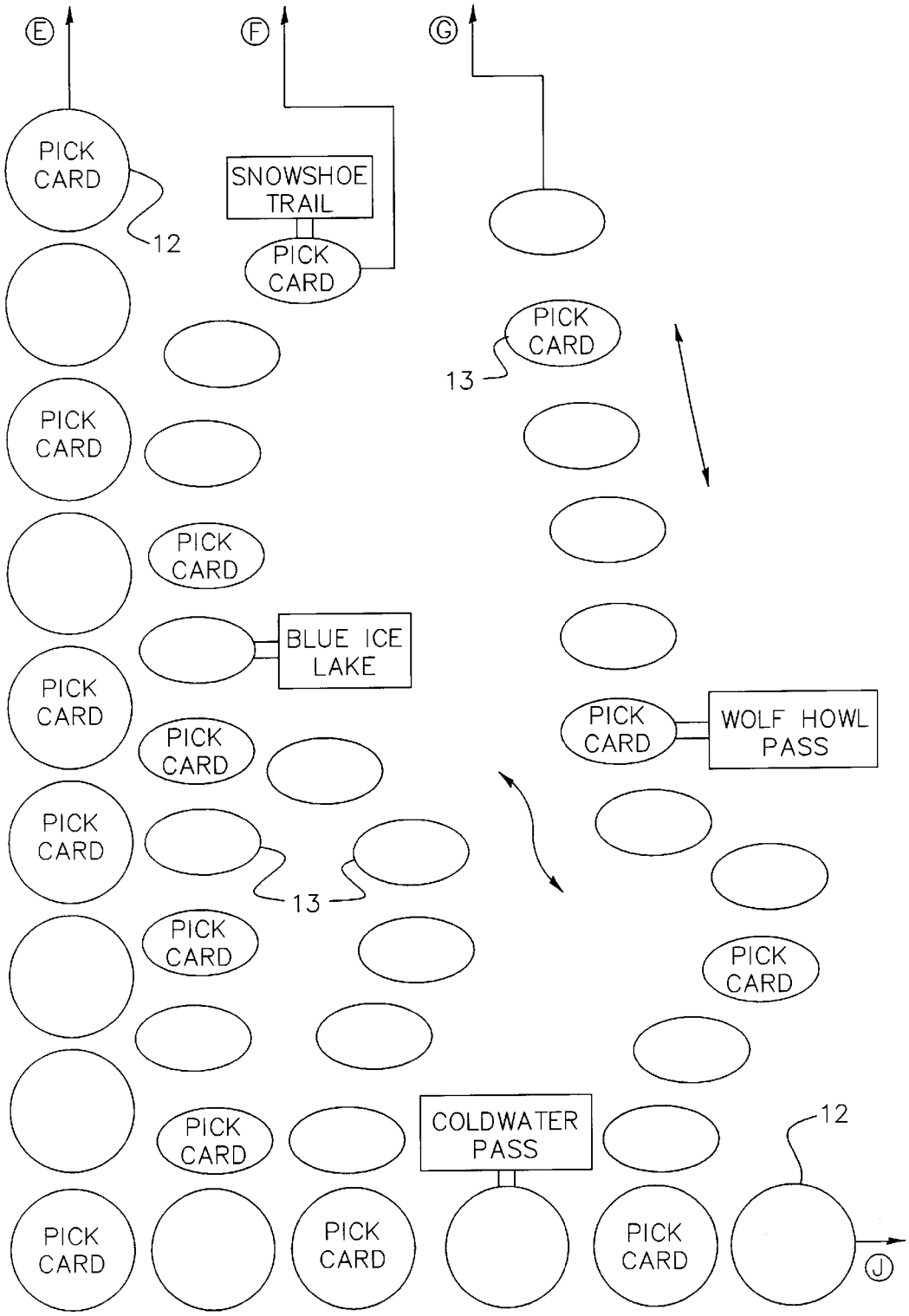
Figure 1D:
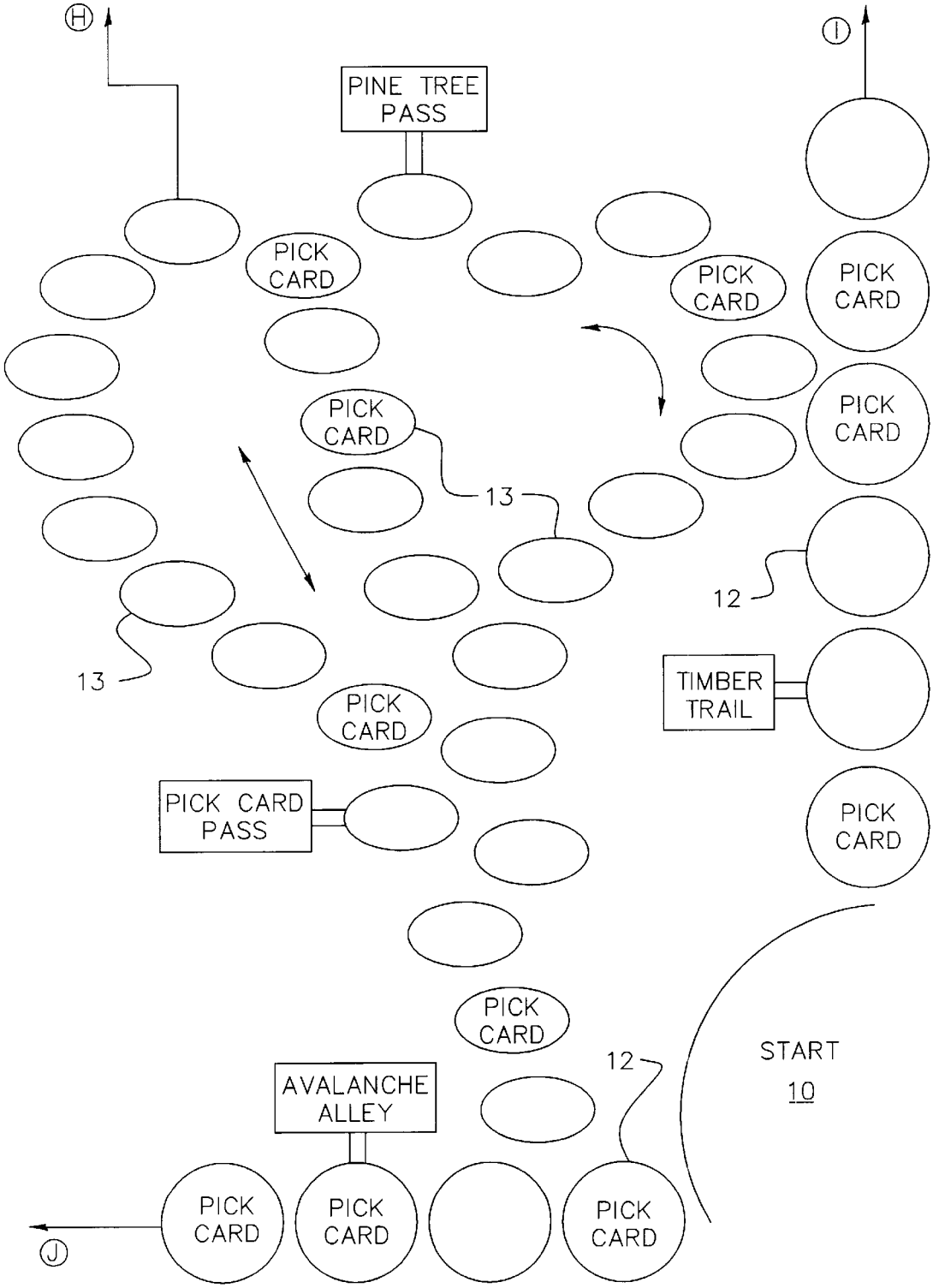

| | |
|---|---|
| FIG. 1A | FIG. 1B |
| FIG. 1C | FIG. 1D |

BOARD GAME

FIELD OF THE INVENTION

This invention is a board game involving movement of players' pieces along various paths in a race from start to finish. I call the game "Sledrace".

BACKGROUND OF THE INVENTION

Board games of many different kinds are well known in the prior art. Sorry®, Parchesi®, and Monopoly® are examples, and they are the most relevant prior art that I know of. Sorry® and Parchesi® each involve movement of players' pieces along a certain course to a finish line, with various hazards and setbacks encountered along the way. Monopoly® is not a race to a finish line but does include, in addition to the uncertainty of the dice, the further uncertainty of penalties, bonuses, etc. from cards drawn when a player lands on certain spaces on the board.

SUMMARY OF THE INVENTION

A board game according to this invention includes a starting point, a finish line, and numerous interconnecting trails therebetween, the trails including "pick card" spaces. The game is played as follows, starting with a first player:

(a) rolling a die (or spinning a dial) to get a random number;

(b) moving a piece that number of spaces along a selected trail on the board;

(c) the player, if his/her marker lands on a "pick card" space, picking a card from a deck of cards and following instructions thereon affecting that player or other player(s); and (d) steps (a) through (c) performed in turn by a second player, and as many other players as are in the game.

DRAWING

The drawing FIGURE shows the board or playing surface for this game.

DESCRIPTION

The Sledrace game requires a game board, a deck of Sledrace cards, and a single die (or spinner dial) to generate random numbers.

The drawing represents the Sledrace playing board. The board shows a starting point 10, finish line 11, and numerous interconnecting trails between start and finish. Trails are marked out by round spaces 12 (or long ovals 13 to indicate narrow trails). Trails interconnect at a number of locations on the board to form something of a maze. There are approximately 150 round (or oval) spaces on the board. About one third of these are "Pick Card" spaces. The playing board is illustrated with pictures and graphics for atmosphere.

A Sledrace card deck is placed on the board in the space indicated. The card deck presently includes some 106 cards, bearing some 85 different messages or instructions. Several of the messages appear on more than one card. That is to say, several of the cards are duplicates (e.g. eight of the cards say "move ahead one space"; four cards say "move back one space"; and so on) but most of the cards are one-of-a-kind.

Sledrace cards have various messages instructing, penalizing, or rewarding the player drawing the card. The cards variously instruct the player to move ahead; move back; move elsewhere; lose turn(s); move other player(s); and so on. Most of these instructions are given with picturesque descriptions of the surrounding circumstances, such as weather conditions, equipment failure, and so on. Specific content of the Sledrace cards is set forth in the Appendix to this specification.

The game is played as follows:

Players roll a die (or spin a dial) to see who goes first. Other players follow the first player in order (e.g. clockwise).

Players may move from start by either the left trail or the right trail.

After the start, players may use any of the many trails.

A player landing on a Pick Card space takes a card from the Sledrace deck and follows its instructions.

If a player moves back and forth from one Pick Card space to another for two turns, the player may roll die on next turn and move the number of spaces indicated.

The object is to reach the finish line first. A player must roll the exact number of spaces in order to reach the finish line.

The roll of a die is mentioned throughout this specification, and in the Appendix hereto. Reference to roll of a die is a convenient way to indicate a means to generate a random number, and as the equivalent of the spin of a dial or the like, for the same purpose.

The Sledrace game lends itself to play on a computer screen, in addition to its "normal" play on a board, and such use is contemplated in the appended claims. In this form, the game board will appear on the screen, and choices are made by the mouse.

The foregoing description of a preferred embodiment of this invention, including the configuration of the playing board and trails, is intended as illustrative. The concept and scope of the game are not limited by these examples but only by the following claims and equivalents thereof.

APPENDIX

List of Sledrace Pick Cards

| Item | Qty. | Message on Card |
|---|---|---|
| Cards | (8) | Move ahead one space. |
| Cards | (4) | Move back one space. |
| Cards | (2) | Move ahead 3 spaces. |
| Cards | (2) | Roll the die and move ahead the number rolled. |
| Cards | (2) | Blizzard causes you to be disoriented. Skip the next turn and wait until it settles down a bit. |
| Cards | (2) | Pick a player to send back 3 spaces. If player complains, send him/her back 5 spaces. |
| Cards | (2) | You are pushing yourself and your dogs too hard! Skip next turn to rest up. |
| Cards | (2) | Advance (or go back) to an alternate route, and move 4 spaces along the alternate route. |
| Cards | (2) | Polar bears ahead! Move ahead 2 spaces on alternate route, or go back 2 spaces. |
| Cards | (2) | A sudden storm sets you back 3 spaces! |
| Cards | (2) | Dogs are running well! Move ahead 5 spaces. |
| Cards | (2) | If a greenhorn got airlifted out of the game, he/she may re-enter as if he/she has been racing all along and advance to Wolf Howl Pass. If greenhorn is still mad for being airlifted out earlier, and refuses to re-enter the game, then you may move ahead 6 spaces. |
| Card | | You just rolled the sled again! Take it easy going around those corners! Skip next turn to get things back in order. |
| Card | | Move ahead 2 spaces. Send the player to your left to Aurora Trail. |

APPENDIX-continued

List of Sledrace Pick Cards

| Item | Qty. | Message on Card |
|---|---|---|
| Card | | Move back 3 spaces. |
| Card | | Move ahead one space. Watch out! Ice is cracking! Get Moving! |
| | | Move ahead another 2 spaces. That was a close one! |
| Card | | Move ahead 3 spaces down alternate route, or go back 3 spaces to avoid wolf pack. |
| Card | | Advance (or go back) to Blue-Ice Lake. |
| Card | | Move one space southwest of Snowdrift Trail.. |
| Card | | Roll the die. Tell the player on your left to move ahead the number rolled. |
| Card | | You've stopped too often, for too long. You have to try to make up for lost time. Move ahead 4 spaces on alternate route. If no alternate route is available, roll the die and move ahead the number rolled. |
| Card | | A minor earthquake leaves you with a twisted ankle. Skip next two turns to check it |
| Card | | Wind picks up behind you, moving you ahead 5 spaces. |
| Card | | Quit whining! You made it this far. |
| | | Finish what you start for once in your life. Move ahead 4 spaces. |
| Card | | Good weather conditions put you ahead 3 spaces. |
| Card | | Move east of Nakia's Trail by 4 spaces. |
| Card | | Some of your gear came loose and rolled off the sled. Go back one space. |
| Card | | Roll the die and move back the number rolled. |
| Card | | Roll the die and move ahead the number rolled. Then roll the die again and have the player to your left move back the number rolled. |
| Card | | You packed too much junk food. Skip next turn to lighten the load. |
| Card | | You stopped to help the player on your right who ran into a low tree branch. Both of you must skip the next turn. Ouch! |
| Card | | Dogs are acting nervous, and you hear loud crunching footsteps in the snow behind you. Don't look back! Can't see anything anyway, it's too dark. |
| | | Move ahead 6 spaces down alternate route, or roll the die and move ahead the number rolled. |
| Card | | The Northern Lights are really putting on a show. the others are all stopped to look, but you want to win this race and are not sidetracked. |
| | | Move ahead 6 spaces. |
| Card | | You skimped on buying gloves and boots for the trip, and now you are paying for it. Your are frostbitten and have to radio for help. This is no place for a greenhorn. You, your dogs, and sled will be airlifted out. Sorry! |
| Card | | Dogs are reaching for the finish line. Move ahead 3 spaces. |
| Card | | Get real! What do you think this is, a talent show? Your dogs don't want to hear you sing! Their howling should tell you this. You're hindering their performance. Please! Skip next turn and let the dogs get back to normal. |
| Card | | Advance to the nearest Pick Card location. |
| | | Follow instructions on the card picked. |
| Card | | You had to use parts of the sled for firewood last night, making it lighter. |
| | | Move ahead 3 spaces. |
| Card | | Dogs need a rest. Skip the next turn. |
| Card | | Make camp. Skip the next turn. |
| Card | | You can do it! Don't give up now! Move ahead 4 spaces. |
| Card | | Set up camp at Coldwater Pass. |
| Card | | Tell the player on your right to move ahead one space. |
| Card | | Advance (or go back) to Avalanche Alley. |
| Card | | You're coming up on what looks like an . . . igloo? It's hard to see through the blowing snow, but . . . yes, it is an igloo! Someone is flagging you down and offering you some hot chocolate. BRRR! Go ahead, have some, but don't stay too long if you want to win this race. Skip next turn only. |
| Card | | Just look at all those stars! WOW! OK, let's not forget why you're out in this −40° weather. You can watch the stars as you mush along two spaces. |
| | | MUSH! |
| Card | | Advance (or go back) to nearest alternate route, and move one space ahead down alternate route. |
| Card | | Advance (or go back) to Echo Pass. |

APPENDIX-continued

List of Sledrace Pick Cards

| Item | Qty. | Message on Card |
|---|---|---|
| Card | | Tell a joke. If anyone laughs, move ahead 6 spaces. If no one laughs, move back 6 spaces. (If you don't know any jokes, move ahead only one space.) |
| Card | | Move back 4 spaces, and send the player to your right to Pine Tree Pass. |
| Card | | All players meet 2 spaces north-northwest of Blizzard Pass. All players now roll the die. Player with highest number starts over from this location (on main trail, not on alternate route). |
| Card | | Advance (or go back) to Pick Card Pass, and consume some munchies for energy. Then pick a card and follow instructions on the card. |
| Card | | Advance (or go back) to Blizzard Pass. |
| Card | | Move north of Blue Ice Lake by 2 spaces. |
| Card | | All players roll the die. Two players with highest number rolled, advance (or go back) to Wolf Howl Pass and start over from there. |
| | | All other players, move ahead 2 spaces. |
| Card | | Advance (or go back) to Timber Trail. |
| Card | | You and the player on your right must each roll the die. Whoever gets the higher number must advance (or go back) to Pine Tree Pass. |
| Card | | Passage on trail is too narrow, blocked by snow. Move ahead 3 spaces on alternate route, or go back 3 spaces. |
| Card | | Advance (or go back) to Polar Bear Alley. |
| Card | | An avalanche has blocked off the trail. Go back 2 spaces, or go ahead 2 spaces on an alternate route. |
| Card | | Move west of Pine Tree Pass by one space. |
| Card | | Too much cloud cover. You can't tell where you're going and you busted your compass when you slipped and fell on ice this evening. What a mess! You start to panic, but then you see a sign that says "Pick Card Pass 3 miles ahead." Move to Pick Card Pass and follow instructions on the card picked. |
| Card | | Advance (or go back) to Aurora Trail. |
| Card | | Move to within 4 spaces of the finish line (on any trail). If you are already within 4 spaces of the finish line, move to within 4 spaces of the starting line (on any trail). Ha Ha! Hey, its my game; I can do this! |
| Card | | Move south of Echo Pass by 2 spaces. |
| Card | | Advance(or go back) to Nakia's Trail |
| Card | | During warm-up exercises this morning, you got a cramp in your leg. |
| | | Skip next turn to loosen up and relax. |
| Card | | Time to break camp and head out. Oh, great! One of the dogs got loose, and just took off after a rabbit. Better get out the treats to get him back. |
| | | Skip the next turn. |
| Card | | The player on your left just zoomed past you. Have him/her move one space ahead of where you are on the trail. If that player is already there, roll the die and move ahead by the number rolled. |
| Card | | Skip next 2 turns. |
| Card | | You're WHAT? TIRED? Oh, come on! How do you think the dogs feel? |
| | | Don't be such a baby! OK, skip the next two turns to rest. |
| Card | | You bit into a candy bar, and now you have sparked a toothache! |
| | | Skip the next turn to relieve the pain. |
| Card | | Tell the player to your right to move back one space. |
| Card | | Advance (or go back) to Pick Card Pass, and consume some munchies for energy. Then pick a card and follow the instructions on the card. |
| Card | | Move west of Pine Tree Pass by one space. |
| Card | | Advance (or go back) to Snowdrift Trail |
| Card | | You are gaining on another sled team, and are now passing them up. |
| | | Switch places with whoever is closest to the finish line. If you are the closest, then roll the die and move ahead the number rolled. |
| Card | | You passed up the trail! Go back 5 spaces. |
| Card | | Tell the player on your right to move back one space. |
| Card | | You find a shortcut! Advance to Wolf Howl Pass. If you |

APPENDIX-continued

List of Sledrace Pick Cards

| Item | Qty. | Message on Card |
|---|---|---|
| | | are already past Wolf Howl Pass, roll the die and move ahead the number rolled. |
| Card | | Broken ice ahead. Move 3 spaces on alternate route, or go back 3 spaces. |
| Card | | Move one space northeast of Blizzard Pass. |
| Card | | Advance (or go back) to Snowshoe Trail. |
| Card | | Hum a tune. If someone recognizes it, that's nice. Move back 2 spaces anyway! If you refuse to hum a tune, move back 4 spaces. Ha Ha! This is fun. |
| Card | | Stop and think about what you are doing! You left behind 2 of your dogs! Go back 2 spaces to get them. |
| Card | | One of the dogs is beginning to limp. Skip the next two turns to check it out. |

What is claimed is:

1. A method of playing a game by a plurality of players on a board with a staring point, a finish line, and numerous interconnecting trails therebetween, said trails marked by spaces including "pick card" spaces, said game comprising the following steps:

(a) determining a first player to begin play of the game;

(b) generating a random number from 1 through 6 for said first player;

(c) moving a marker piece of said first player said random number of spaces along a trail selected from among said numerous trails;

(d) if said marker lands on a "pick card" space, picking a card from a deck of "sledrace" cards and following instructions thereon affecting said first player or other player(s); and (e) steps (b) through (d) performed by a second player and, successively, by as many other players as are in the game; and (f) steps (b through (e) repeated until one of said players reaches said finish line;

(g) moves of said players from said starting point being along either a left starting trail or a right starting trail;

(h) moves of said players after their starting moves being either forward or rearward as desired;

wherein said card in step (d) is one selected from the following list of cards:

| Item | Qty | Message/Instruction on Card |
|---|---|---|
| Cards | (8) | Move ahead one space. |
| Cards | (4) | Move back one space. |
| Cards | (2) | Move ahead 3 spaces. |
| Cards | (2) | Roll the die and move ahead the number rolled. |
| Cards | (2) | Blizzard makes you disoriented. Skip the next turn. Wait until it settles down a bit. |
| Cards | (2) | Pick a player to send back 3 spaces. If player complains, send him/her back 5 spaces. |
| Cards | (2) | You are pushing yourself and your dogs too hard! Skip next turn to rest up. |
| Cards | (2) | Advance (or go back) to an alternate route, and move 4 spaces along the alternate route. |
| Cards | (2) | Polar bears ahead! Move ahead 2 spaces on alternate route, or go back 2 spaces. |
| Cards | (2) | A sudden storm sets you back 3 spaces! |
| Cards | (2) | Dogs are running well! Move ahead 5 spaces. |

-continued

| Item | Qty | Message/Instruction on Card |
|---|---|---|
| Cards | (2) | If a greenhorn got airlifted out of the game, he/she may re-enter as if he/she has been racing all along and advance to Wolf Howl Pass. If greenhorn is still mad for being airlifted earlier, and refuses to re-enter the game, then you may move ahead 6 spaces. |
| Card | | You just rolled the sled again! Take it easy going around those corners! Skip next turn to get things back in order. |
| Card | | Move ahead 2 spaces. Send the player to your left to Aurora Trail. |
| Card | | Move back 3 spaces. |
| Card | | Move ahead one space. Watch out! Ice is cracking! Get Moving! Move ahead another 2 spaces. That was a close one! |
| Card | | Move ahead 3 spaces down alternate route, or go back 3 spaces to avoid wolf pack. |
| Card | | Advance (or go back) to Blue-Ice Lake. |
| Card | | Move one space southwest of Snowdrift Trail. |
| Card | | Roll the die. Tell the player on your left to move ahead the number rolled. |
| Card | | You've stopped too often, for too long. You have to try to make up for lost time. Move ahead 4 spaces on alternate route. If no alternate route is available, roll the die and move ahead the number rolled. |
| Card | | A minor earthquake leaves you with a twisted ankle. Skip next two turns to check it |
| Card | | Wind picks up behind you, moving you ahead 5 spaces. |
| Card | | Quit whining! You made it this far. Finish what you start for once in your life. Move ahead 4 spaces. |
| Card | | Good weather conditions put you ahead 3 spaces. |
| Card | | Move east of Nakia's Trail by 4 spaces. |
| Card | | Some of your gear came loose and rolled off the sled. Go back one space. |
| Card | | Roll the die and move back the number rolled. |
| Card | | Roll the die and move ahead the number rolled. Then roll the die again and have the player to your left move back the number rolled. |
| Card | | You packed too much junk food. Skip next turn to lighten the load. |
| Card | | You stopped to help the player on your right who ran into a low tree branch. Both of you must skip the next turn. Ouch! |
| Card | | Dogs are acting nervous, and you hear loud crunching footsteps in the snow behind you. Don't look back! Can't see anything anyway, it's too dark. Move ahead 6 spaces down alternate route, or roll the die and move ahead the number rolled. |
| Card | | The Northern Lights are really putting on a show. The others have stopped to look, but you want to win this race and are not sidetracked. Move ahead 6 spaces. |
| Card | | You skimped on buying gloves and boots for the trip, and now you are paying for it. Your are frostbitten and have to radio for help. This is no place for a greenhorn. You, your dogs, and sled will be airlifted out. Sorry! |
| Card | | Dogs are reaching for the finish line. Move ahead 3 spaces. |
| Card | | Get real! What do you think this is, a talent show? Your dogs won't want to hear you sing! Their howling should tell you this. You're hindering their performance. Please! Skip next turn and let the dogs get back to normal. |
| Card | | Advance to the nearest Pick Card location. Follow instructions on the card picked. |
| Card | | You had to use parts of the sled for firewood last night, making it lighter. Move ahead 3 spaces. |
| Card | | Dogs need a rest. Skip the next turn. |
| Card | | Make camp. Skip the next turn. |
| Card | | You can do it! Don't give up now! Move ahead 4 spaces. |
| Card | | Set up camp at Coldwater Pass. |
| Card | | Tell the player on your right to move ahead one space. |
| Card | | Advance (or go back) to Avalanche Alley. |
| Card | | You're coming up on what looks like an . . . igloo? It's hard to see through the blowing snow, but . . . yes, it is an igloo! Someone is flagging you down and offering you |

-continued

| Item | Qty | Message/Instruction on Card |
|---|---|---|
| | | some hot chocolate. BRRR! Go ahead, have some, but don't stay too long if you want to win this race. Skip next turn only. |
| Card | | Just look at all those stars! WOW! OK, let's not forget why you're out in this −40° weather. You can watch the stars as you mush along two spaces. MUSH! |
| Card | | Advance (or go back) to nearest alternate route, and move one space ahead down alternate route. |
| Card | | Advance (or go back) to Echo Pass. |
| Card | | Tell a joke. If anyone laughs, move ahead 6 spaces. If no one laughs, move back 6 spaces. (If you don't know any jokes, move ahead only one space.) |
| Card | | Move back 4 spaces, and send the player to your right to Pine Tree Pass. |
| Card | | All players meet 2 spaces north-northwest of Blizzard Pass. All players now roll the die. Player with highest number starts over from this location (on main trail, not on alternate route). |
| Card | | Advance (or go back) to Pick Card Pass, and consume some munchies for energy. Then pick a card and follow instructions on the card. |
| Card | | Advance (or go back) to Blizzard Pass. |
| Card | | Move north of Blue Ice Lake by 2 spaces. |
| Card | | All players roll the die. Two players with highest number rolled, advance (or go back) to Wolf Howl Pass and start over from there. All other players, move ahead 2 spaces. |
| Card | | Advance (or go back) to Timber Trail. |
| Card | | You and the player on your right must each roll the die. Whoever gets the higher number must advance (or go back) to Pine Tree Pass. |
| Card | | Passage on trail is too narrow, blocked by snow. Move ahead 3 spaces on alternate route, or go back 3 spaces. |
| Card | | Advance (or go back) to Polar Bear Alley. |
| Card | | An avalanche has blocked off the trail. Go back 2 spaces, or go ahead 2 spaces on an alternate route. |
| Card | | Move west of Pine Tree Pass by one space. |
| Card | | Too much cloud cover. You can't tell where you're going and you busted your compass when you slipped and fell on ice this evening. What a mess! You start to panic, but then you see a sign that says "Pick Card Pass 3 miles ahead." Move to Pick Card Pass and follow instructions on the card picked. |
| Card | | Advance (or go back) to Aurora Trail. |
| Card | | Move to within 4 spaces of the finish line (on any trail). If you are already within 4 spaces of the finish line, move to within 4 spaces of the starting line (on any trail). Ha Ha! Hey, its my game; I can do this! |
| Card | | Move south of Echo Pass by 2 spaces. |
| Card | | Advance(or go back) to Nakia's Trail |

-continued

| Item | Qty | Message/Instruction on Card |
|---|---|---|
| Card | | During warm-up exercises this morning, you got a cramp in your leg. Skip next turn to loosen up and relax. |
| Card | | Time to break camp and head out. Oh, great! One of the dogs got loose, and just took off after a rabbit. Better get out the treats to get him back. Skip the next turn. |
| Card | | The player on your left just zoomed past you. Have him/her move one space ahead of where you are on the trail. If that player is already there, roll the die and move ahead by the number rolled. |
| Card | | Skip next 2 turns. |
| Card | | You're WHAT? TIRED? Oh, come on! How do you think the dogs feel? Don't be such a baby! OK, skip the next two turns to rest. |
| Card | | You bit into a candy bar, and now you have sparked a toothache! Skip the next turn to relieve the pain. |
| Card | | Tell the player to your right to move back one space. |
| Card | | Advance (or go back) to Pick Card Pass, and consume some munchies for energy. Then pick a card and follow the instructions on the card. |
| Card | | Move west of Pine Tree Pass by one space. |
| Card | | Advance (or go back) to Snowdrift Trail |
| Card | | You are gaining on another sled team, and are now passing them up. Switch places with whoever is closest to the finish line. If you are the closest, then roll the die and move ahead the number rolled. |
| Card | | You passed up the trail! Go back 5 spaces. |
| Card | | Tell the player on your right to move back one space. |
| Card | | You find a shortcut! Advance to Wolf Howl Pass. If you are already past Wolf Howl Pass, roll the die and move ahead the number rolled. |
| Card | | Broken ice ahead. Move 3 spaces on alternate route, or go back 3 spaces. |
| Card | | Move one space northeast of Blizzard Pass. |
| Card | | Advance (or go back) to Snowshoe Trail. |
| Card | | Hum a tune. If someone recognizes it, that's nice. Move back 2 spaces anyway! If you refuse to hum a tune move back 4 spaces. HaHa! This is fun |
| Card | | Stop and think about what you are doing! You left behind 2 of your dogs! Go back 2 spaces to get them. |
| Card | | One of the dogs is beginning to limp. Skip the next two turns to check it out. |

* * * * *